US007351109B2

(12) United States Patent
Wang

(10) Patent No.: US 7,351,109 B2
(45) Date of Patent: Apr. 1, 2008

(54) CONNECTOR ASSEMBLY ADAPTED TO RECEIVE TWO MEMORY CARDS

(75) Inventor: Hsu-Fen Wang, Taipei (TW)

(73) Assignee: Advanced Connectek Inc., Taipei (TW)

( * ) Notice: Subject to any disclaimer, the term of this patent is extended or adjusted under 35 U.S.C. 154(b) by 0 days.

(21) Appl. No.: 11/652,136

(22) Filed: Jan. 11, 2007

(65) Prior Publication Data

US 2007/0249185 A1 Oct. 25, 2007

(30) Foreign Application Priority Data

Jan. 13, 2006 (TW) ..... 095200853

(51) Int. Cl.
*H01R 24/00* (2006.01)

(52) U.S. Cl. ..... 439/631

(58) Field of Classification Search ..... 439/630, 439/631, 607, 949

See application file for complete search history.

(56) References Cited

U.S. PATENT DOCUMENTS

| | | | | |
|---|---|---|---|---|
| 5,750,973 | A * | 5/1998 | Kaufman et al. | 235/441 |
| 6,241,545 | B1 * | 6/2001 | Bricaud et al. | 439/326 |
| 7,014,492 | B1 * | 3/2006 | Lim et al. | 439/331 |
| 7,104,809 | B1 * | 9/2006 | Huang | 439/76.1 |
| 7,238,051 | B2 * | 7/2007 | Miyawaki et al. | 439/630 |

FOREIGN PATENT DOCUMENTS

| | | |
|---|---|---|
| JP | 093219105 | 6/2005 |

* cited by examiner

*Primary Examiner*—Briggitte R. Hammond
(74) *Attorney, Agent, or Firm*—Troxell Law Office, PLLC

(57) ABSTRACT

A connector assembly adapted to receive a subscriber identity module (SIM) card connector and a memory card connector is disclosed. A recess with a stepped configuration disposed adjacently to an insulative housing forms a multi-level space with a shielding shell, and therefore terminals of each connector are separated from each other and each connector has its own shielding shell.

10 Claims, 3 Drawing Sheets

CONNECTOR ASSEMBLY ADAPTED TO RECEIVE TWO MEMORY CARDS

BACKGROUND OF THE INVENTION

1. Field of the Invention

The present invention relates to a connector assembly, and more particularly to a connector assembly adapted to receive two different memory cards simultaneously.

2. Description of the Prior Art

The usage rate of mobile phone has greatly increased in the twentieth century, today in the twenty-first century, in some area, the rate has reached or even exceed an average of a mobile phone per person. With the development of science and technology, the mobile phone not only is used for communication but also has many different and comprehensive functions. Generally speaking, the development of the comprehensive function is divided into two periods, in the first period, the wire free transmission function is significantly improved so that the transmissible signal of the phone changes from sound to text and figure; in the second period, the mobile phone, together with electrical products as a unit, has the same functions as those electrical products, the former is a soft portion; and the latter is a hard portion, especially when the requirements of the hard portion-lightness, thinness, shortness, smallness of the hard portion can be satisfied by the development of science and technology, the multi-function mobile phone is highlighted. For example, the mobile phone equipped by the integrated digital camera is a glaring invention, the conventional camerophone held the digital image obtained by the photographic lens in the memory of its circuit board, however the memory is limited and can not be expanded. Due to the ever-increasing pixel and the appearances mobile phone with various functions, such as mobile phone with MP3 player which stores music file in MP3 format in the memory, or mobile phone with a microphone has the function of tape recording, or even the mobile phone plays the role of a mobile storage for storing electronic document, mobile phone may have more functions as other electronic products, however more functions it has, more memory it will need. In an attempt to meet the need of memory, an external expandable storage memory card is provided.

A circuit board of mobile phone has at least two memory card connectors, one is SIM card connector identifying the user's document, the other is memory card connector reading documents stored in the above-mentioned external expandable memory card. A laminated connector integrating a mini memory card with a SIM card is disclosed with respect to lightness, thinness, shortness, and smallness. FIG. 4 is a bottom surface perspective view of a laminated connector, disclosed in Taiwanese Utility Model Patent No. M267,715, providing a space A, the bottom surface thereof is a hollow portion defined below the space A, a compartment B is disposed in the appropriate position of the space A set forth and divides it into memory card module C with conductive terminal group C1 on one end and the SIM card D with conductive terminal group D1 on bottom surface thereof, finally, a shielding shell E covers the upper of the connector.

According to the invention, the compartment B is primarily applied to separate the memory card module C from the SIM card D in space, it is understood from the embodiment that the compartment B is actually the insulative housing of terminal group D1 of SIM card D. As indicated in the embodiment, the terminal group D1 is set on the bottom surface of the SIM card D, and also is the bottom surface of the compartment B, since the bottom surface of the space A is a hollow portion, there is not shielding but interference between the terminal group D1 and memory card module C, it is prone to wrong contact. The objection of this invention is to overcome the above disadvantage though optimization designs.

SUMMARY OF THE INVENTION

The main purpose of the present invention is to provide a connector assembly which can improve the shielding effect of the memory card connector and avoid the interference between the SIM card connector and the memory card connector.

Another purpose of the present is to provide a connector assembly which can indeed separate terminals of the SIM card connector from those of memory card connector to avoid wrong contact.

Yet another purpose of the present is to provide a connector assembly which forms a guiding recess on the shielding shell to ensure prefect guiding and fixing effect when inserting the SIM card.

Still another purpose of the present is to provide a connector assembly which set a raised corner at one side of the insulative housing so as to form unfilled corner at the insertion spaces of the SIM card and the memory card simultaneously to avoid wrong insertion.

To achieve the above objects, the present invention has its particular constructions and characterizes as indicated below. According to the embodiment of the invention, the connector assembly comprises an insulative housing, a plurality of first terminals, a plurality of second terminals, a first shielding shell and a second shielding shell. The insulative housing includes a first recess and a second recess which is adjacent to and lower than the first recess, the cross section of the first and the second recess is a trapezoid in shape. A plurality of first accommodating slots forming in the inner of the first recess are applied to accommodate the plurality of first terminals, and a plurality of second accommodating slots forming in the inner of the second recess are applied to accommodate the plurality of second terminals. The second shielding shell covers the second recess so as to keep its top surface at the same level with the bottom surface of the first recess, and the first shielding shell covers the first and the second recess, so two separate spaces are formed, the one which is formed by the first recess and the second shielding shell and the first shielding shell is defined as a first space, the other which is formed by the second recess and the second shielding shell is defined as a second space, the first and the second spaces are applied to receive different memory cards and these memory cards can insert and operate simultaneously.

According to one aspect of the present invention, the first and the second shielding shell cover the first and the second space respectively and provide separate shielding effect for two connectors to prevent efficiently the interference between the two connectors, furthermore, the first recess is adjacent to the second recess, so wrong contact between the two connectors is impossible.

According to another aspect of the present invention, a lug formed on the second shielding shell which is flush with the bottom surface of the first recess is applied as guiding recess to facilitate the insertion of memory card into the first space to achieve a prefect guiding and fixing effect.

At the same time, on the lateral corner of the second recess having a raised corner of the insulative housing, since the lower space of the second recess is defined as the second space, and the upper space cooperating with the first recess forms the first space, the raised corner forms unfilled corners with the first space and the second space respectively and simultaneously. The mating of the unfilled corner which is located on the lateral corner of the second recess and the unfilled corner of memory cards could avoid wrong insertion of memory cards.

The spirits and the technical characteristics of the invention will be better understood by reference to the following detailed description of the preferred embodiments.

DETAILED DESCRIPTION OF THE PREFERRED EMBODIMENTS

Figure 1:
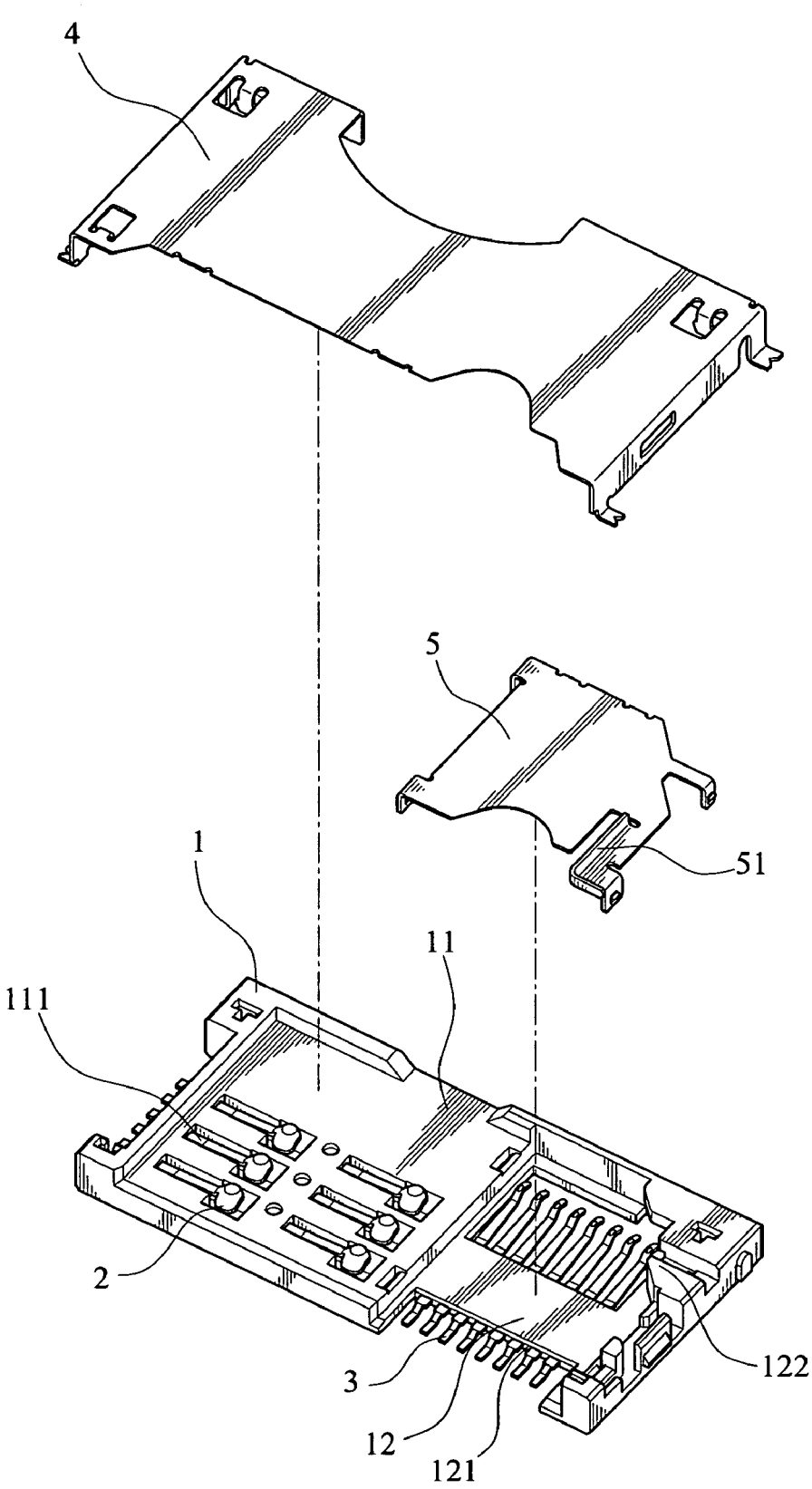
FIG. 1 is a perspective exploded view showing a connector assembly according to a preferred embodiment of the present invention.
Figure 2:
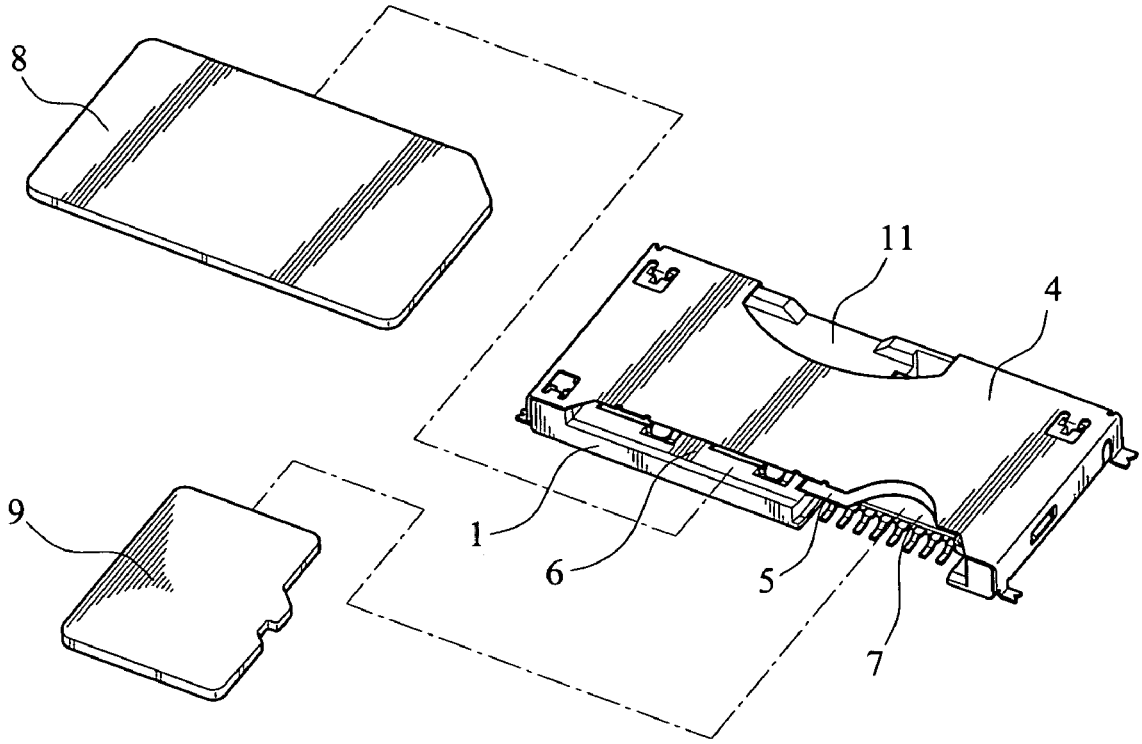
FIG. 2 is a first operational perspective view showing the connector assembly shown in FIG. 1.
Figure 3:
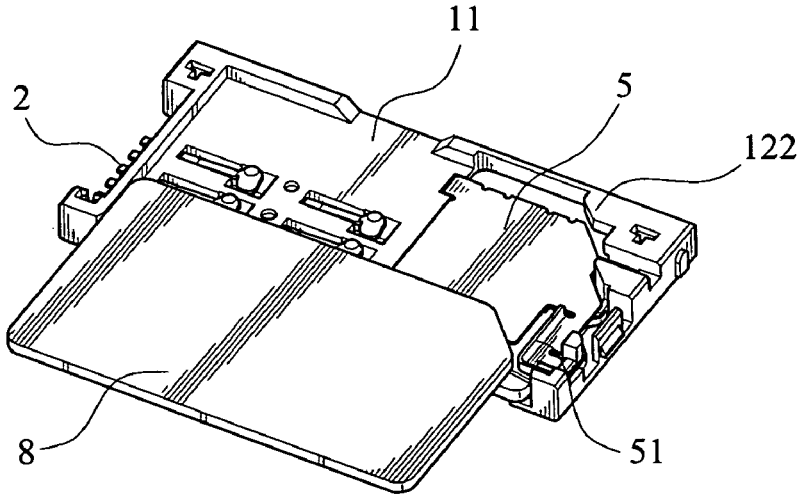
FIG. 3 is a second operational perspective view showing the connector assembly shown in FIG. 1.
Figure 4:
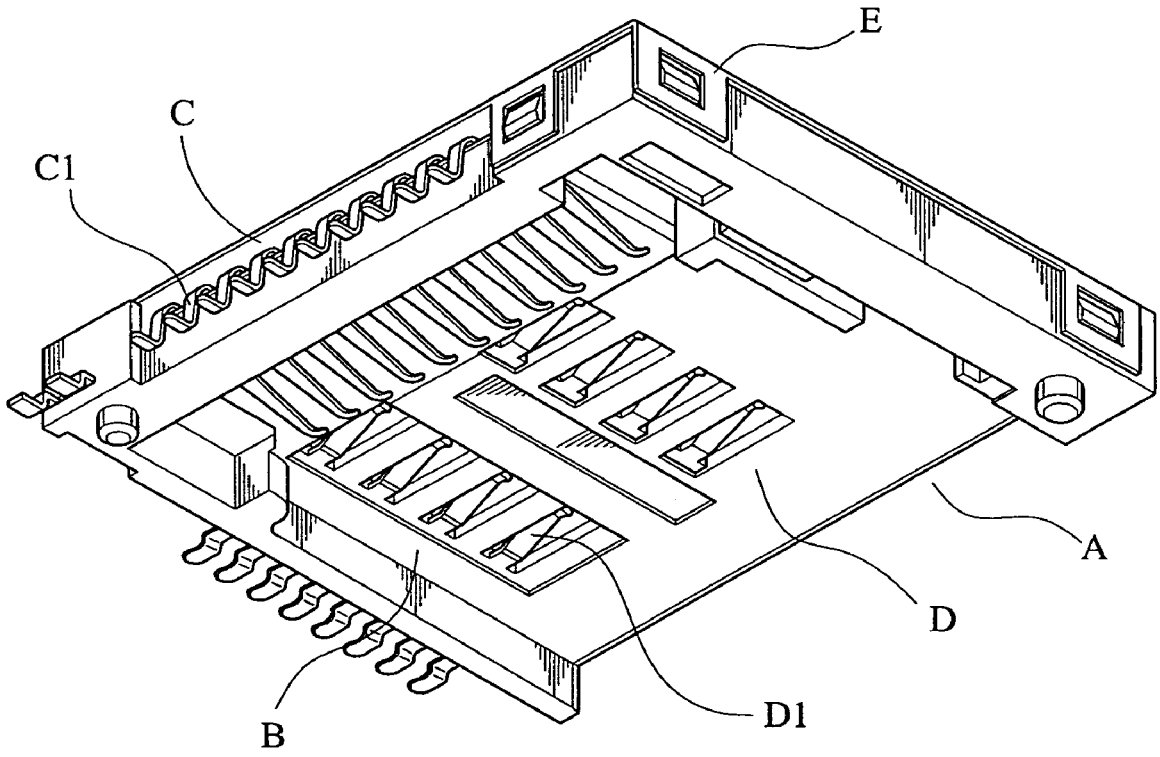
FIG. 4(Prior Art)
FIG. 4 is a perspective view showing a conventional stack connector.

FIGS. 1 to 3 show a preferred embodiment of the connector assembly of the present invention. The connector assembly comprises an insulative housing 1, a plurality of first terminals 2, a plurality of second terminals 3, a first shielding shell 4 and a second shielding shell 5. The insulative housing 1 is provided with a first recess 11 and a second recess 12 adjacent to the first recess 11, and the second recess 12 is lower than the first recess 11. The cross section of the first recess 11 and the second recess 12 form a stepped configuration. Formed in the inner of the first recess 11 are a plurality of first accommodating slots 111 which are adapted to accommodate a plurality of first terminals 2. Formed in the inner of the second recess 12 are a plurality of second accommodating slots 121 which are adapted to accommodate a plurality of second terminals 3. The second shielding shell 5 covers the second recess 12 so as to make its top surface at the same level with the bottom surface of the first recess 11, and the first shielding shell 4 covers the upper of the first recess 11 and the second recess 12, a first space 6 is formed by the first recess 11 and the second shielding shell 5 and the first shielding shell 4, a second space 7 is formed by the second recess 12 and the second shielding shell 5, the first space 6 receives the SIM card 8 and the second space 7 receives micro SD card 9 or any other memory cards with different specifications, the plurality of first terminals 2 and the plurality of second terminals 3 are respectively adapted for the SIM card 8 and micro SD card 9. The SIM card 8 and micro SD card 9 can be inserted and operated simultaneously. The stepped configuration formed by the first recess 11 and the second recess 12 is the opening of the first space 6 and the second space 7, and it facilitates the insertion of the SIM card 8 from side direction, the contact portion of the plurality of first terminals 2 can be designed in the shape of arc.

Actually, the type of memory card inserted into the second space 7 can be varies with the variation of the plurality of second terminals 3. For example, when the plurality of second terminals 3 are substituted by the connector terminal for mini SD card, the second space 7 can also be changed so as to match with the mini SD card. Of course, when the plurality of second terminals 3 is replaced by other connector terminals, the size of the second recess 12 should also be changed in order to match with the new memory card.

According to the invention, a lug 51 bends upwardly from the second shielding shell 5 which is flush with the bottom surface of the first recess 11, so the lug 51 can be used as guiding recess to facilitate smooth insertion of the SIM card 8 into the first space 6 to ensure a prefect guiding and fixing effect. At the same time, the insulative housing 1 provides a raised corner 122 on the lateral corner of the second recess 12, the lower space of the second recess 12 is defined as the second space 7, and the upper space cooperating with the first recess 11 forms the first space 6. Therefore, the raised corner 121 forms unfilled corners with the first space 6 and the second space 7 respectively and simultaneously. The unfilled corners match with those of SIM card 8 and micro SD 9 so as to avoid the wrong insertions of memory cards.

As described above, the preferred embodiment of the invention has been described and illustrated in detail in the purpose of illustration, it should be understood that these are exemplary of the invention and are not to be considered as limiting. Additional modifications and variations thereof made without departing from the spirit or scope of the invention are thought to be similar to this invention and in the scope of appended claims set forth.

What is claimed is:

1. A connector assembly adapted to receive a first and a second memory cards, the connector assembly comprising:

an insulative housing;

a plurality of first terminals;

a plurality of second terminals, a first shielding shell; and a second shielding shell having a top surface;

wherein said insulative housing includes a first recess having a bottom surface and a second recess, the second recess is adjacent to the first recess and lower than said first recess, the first recess is provided with a plurality of first accommodating slots, the second recess is provided with a plurality of second accommodating slots, said plurality of first terminals are mounted in the first accommodating slot, said plurality of second terminals are mounted in the second accommodating slot, said second shielding shell covers the second recess, the top surface of said second shielding shell and the bottom surface of the first recess are disposed at the same level, said first shielding shell covers the first recess and the second recess, a first space is formed by the first recess and the second shielding shell and said first shielding recess, a second space is formed by the second recess and said second shielding shell.

2. The connector assembly as claimed in claim 1, wherein the top surface of said second shielding shell is provided with a lug.

3. The connector assembly as claimed in claim 2, wherein the lug is formed by bending upwardly from said second shielding shell.

4. The connector assembly as claimed in claim 1, wherein a raised corner is formed on one end of the second recess.

5. The connector assembly as claimed in claim 1, wherein both memory cards are inserted into the connector assembly in the same direction.

6. The connector assembly as claimed in claim 1, wherein said plurality of first terminals are adapted to be in contact with the first memory card, and the first space is adapted to accommodate the first memory card.

7. The connector assembly as claimed in claim 6, wherein each of said plurality of first terminals has a contact portion adapted to be electrically connected with the memory card accommodated in the first space.

8. The connector assembly as claimed in claim 1, wherein said plurality of second terminals are adapted to be in contact of the second memory card, and the second space is adapted to accommodate the second memory card.

9. The connector assembly as claimed in claim 1, wherein the first memory card is a subscriber identity module (SIM) card.

10. The connector assembly as claimed in claim 7, wherein the contact portion of the plurality of first terminals is of a shape of arc.

* * * * *